US008505709B2

(12) United States Patent
Kaneko

(10) Patent No.: US 8,505,709 B2
(45) Date of Patent: Aug. 13, 2013

(54) COIN SLOPE

(75) Inventor: Toshihiro Kaneko, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/442,787

(22) Filed: Apr. 9, 2012

(65) Prior Publication Data

US 2012/0255831 A1 Oct. 11, 2012

Related U.S. Application Data

(63) Continuation of application No. 12/272,191, filed on Nov. 17, 2008, now Pat. No. 8,172,068.

(30) Foreign Application Priority Data

Nov. 20, 2007 (JP) ..... 2007-300273

(51) Int. Cl.
*G07F 1/04* (2006.01)

(52) U.S. Cl.
USPC ..... 194/344; 193/DIG. 1

(58) Field of Classification Search
USPC ..... 194/344, 353; 193/DIG. 1, 2 R, 193/32, 33, 38, 40, 41, 46, 47; 463/46, 47; 209/544, 696, 375; 198/523, 525, 534, 533
See application file for complete search history.

(56) References Cited

U.S. PATENT DOCUMENTS

| | | | | |
|---|---|---|---|---|
| 1,534,536 | A | 4/1925 | Meyer | |
| 4,165,802 | A * | 8/1979 | Mathews | 194/344 |
| 5,427,220 | A * | 6/1995 | Nishiumi et al. | 194/317 |
| 6,283,302 | B1 | 9/2001 | Schulte et al. | |
| 2002/0077056 | A1 | 6/2002 | Abe et al. | |

FOREIGN PATENT DOCUMENTS

| | | |
|---|---|---|
| JP | 55-113306 | 8/1980 |
| JP | 57-036978 | 2/1982 |
| JP | 01-090470 | 6/1989 |
| JP | 02-076094 | 3/1990 |
| JP | 03-034178 | 4/1991 |
| JP | 2000-132729 | 5/2000 |
| JP | 2000-339525 | 12/2000 |
| JP | 2007-279777 | 10/2007 |

OTHER PUBLICATIONS

Japanese Office Action dated Sep. 15, 2009 (2 pages), and partial English translation thereof (2 pages), issued in counterpart Japanese Application Serial No. 2007-300273.

Extended European Search Report dated Oct. 1, 2009 (6 pages), issued in counterpart European Application Serial No. 08020110.6.

Decision of Patent Grant, issued in Japanese counterpart Application No. 2010-146659, 4 pages (with English translation).

* cited by examiner

*Primary Examiner* — Mark Beauchaine
(74) *Attorney, Agent, or Firm* — Patterson & Sheridan, L.L.P.

(57) ABSTRACT

A sloping surface slopes downward. Longwise ribs are provided to be adjacent to each other on the sloping surface. The longwise ribs extend from an upper area of the sloping surface to a lower area of the sloping surface. A diagonal rib diagonally crosses a direction orthogonal to a direction of a gravitational force on the sloping surface. The diagonal rib is not taller than the longwise rib.

6 Claims, 16 Drawing Sheets

COIN SLOPE

CROSS REFERENCE TO RELATED APPLICATION

The present application is continuation of U.S. patent application Ser. No. 12/272,191, filed Nov. 17, 2008, which is based on and claims the benefit of priority of Japanese Patent Application No. 2007-300273 filed on Nov. 20, 2007, the entire contents of which are incorporated herein by reference.

BACKGROUND OF THE INVENTION

1. Field of the Invention

The present invention relates to a coin slope for guiding an ejected coin to a coin receiver.

2. Description of the Related Art

A coin slope includes a sloping surface which makes an ejected coin slide down to a coin receiver by its own weight. A conventional coin slope is used as a part of various machines. In Japanese Laid-Open Publication No. 2000-132729 and Japanese Laid-Open Publication No. 2000-339525, a coin slope provided to a vending machine is described. A sloping surface of this coin slope receives a coin ejected from one side of this sloping surface and guides this coin to a coin receiver.

When ribs are provided to a sloping surface of a coin slope in order to reduce a contact resistance against a coin, a problem described below occurs.

FIG. 14 is a side view in vertical section showing a coin slope 1. FIG. 15 is a schematic plan view showing a part of the coin slope 1. The coin slope 1 includes a sloping surface 2. To the sloping surface 2, longwise ribs 3 are provided in order to reduce a contact resistance against a coin C. Usually, the coin C slides down by its own weight to a coin receiver 4 with one side of the coin C on a top surface of the longwise rib 3, as shown in FIG. 15.

However, the coin C which freely falls from directly above the coin slope 1 drops in a gap between the longwise ribs 3 without lying on the longwise rib 3 and rolls down, as shown in FIG. 14. Then, the coin C rushes to the coin receiver 4 and jumps out of the coin receiver 4, as shown in FIG. 14.

For solving the problem described above, a bumping wall 5 may be provided right in front of coin receiver 4. The rolling coin C bumps against the bumping wall 5.

FIG. 16 is a side view in vertical section showing the coin slope 1 to which the bumping wall 5 is provided. The bumping wall 5 weakens a force of the coin C and makes the coin C fall down to the coin receiver 4. But, when the bumping wall 5 is provided, the coin receiver 4 must be provided to a lower position in order to make the coin C which bumps the bumping wall 5 fall down. The position of the coin receiver 4 in FIG. 14 is shown by two-dot chain line in FIG. 16. As the coin receiver 4 is provided to a lower position, an operability of taking the coin C received the coin receiver 4 becomes worse. Therefore, providing the bumping wall 5 in front of the coin receiver 4 should be avoided.

SUMMARY

Accordingly, it is an object of the present invention to prevent a coin which drops in a gap between longwise ribs and rolls down to a coin receiver from jumping out of the coin receiver without providing a bumping wall against which the rolling coin bumps right in front of the coin receiver.

According to one aspect of the present invention, a coin slope includes a sloping surface which slopes downward; longwise ribs which are provided to be adjacent to each other on the sloping surface, and which extend from an upper area of the sloping surface to a lower area of the sloping surface; and a diagonal rib which diagonally crosses a direction orthogonal to a direction of a gravitational force on the sloping surface and which is not taller than the longwise ribs.

According to another aspect of the present invention, a coin slope includes a sloping surface which slopes downward; longwise ribs which are provided to be adjacent to each other on the sloping surface, and which extend from an upper area of the sloping surface to a lower area of the sloping surface; and an interference member which is not taller than the longwise ribs and which includes a slope connected to two adjacent longwise ribs.

According to another aspect of the present invention, a method includes installing a coin ejecting machine which includes a coin outlet through which a coin is ejected; and installing a coin slope in a position to which a coin ejected through the coin outlet falls down. The coin slope includes: a sloping surface which slopes downward; longwise ribs which are provided to be adjacent to each other on the sloping surface, and which extend from an upper area of the sloping surface to a lower area of the sloping surface; and a diagonal rib which diagonally crosses a direction orthogonal to a direction of a gravitational force on the sloping surface and which is not taller than the longwise ribs.

According to a further aspect of the present invention, a method includes installing a coin ejecting machine which includes a coin outlet through which a coin is ejected; and installing a coin slope in a position to which a coin ejected through the coin outlet falls down. The coin slope includes: a sloping surface which slopes downward; longwise ribs which are provided to be adjacent to each other on the sloping surface, and which extend from an upper area of the sloping surface to a lower area of the sloping surface; and an interference member which is not taller than the longwise ribs and which includes a slope connected to two adjacent longwise ribs.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE INVENTION

The first embodiment of the present invention is explained based on FIGS. 1 to 11. The first embodiment is an example of an application to a coin slope 401 which is provided to a self-checkout terminal 101 which is operated by customers for themselves.

Figure 1:
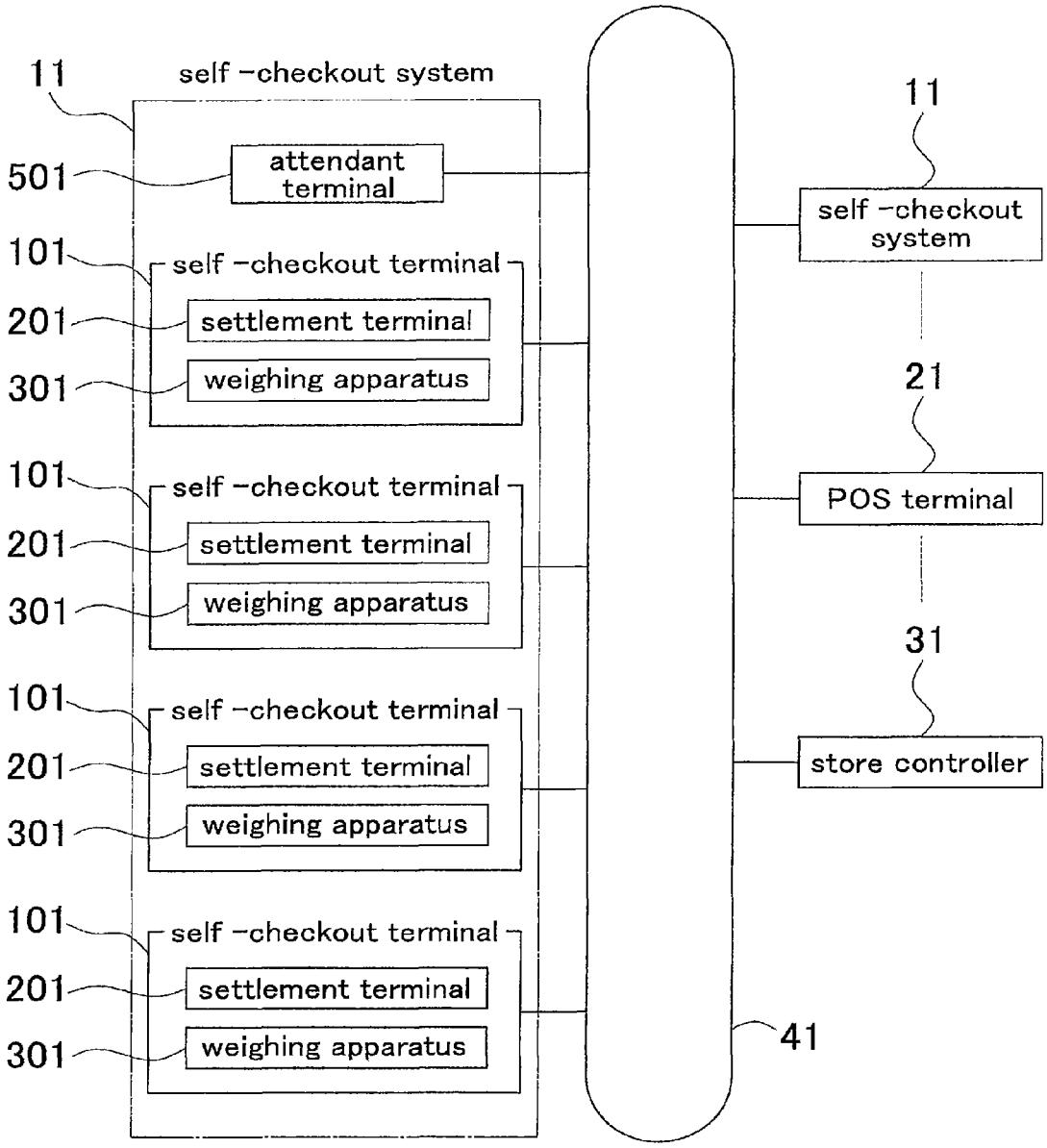
FIG. 1 is a schematic diagram showing a whole system organization.

FIG. 1 is a schematic diagram showing a whole system organization. A system of the first embodiment is established by self-checkout systems 11, POS terminals 21, and a store controller 31 which are connected through a communication network 41.

The self-checkout system 11 includes an attendant terminal 501 which is a kind of a personal computer and the self-checkout terminals 101 which are assigned to the attendant terminal 501. The self-checkout terminal 101 is includes a settlement terminal 201 and a weighing apparatus 301. The settlement terminal 201 performs a merchandise sales data processing based on merchandise codes inputted through a barcode scanner 203 (see FIG. 2) or a touch panel 211 (see FIG. 2).

Figure 2:
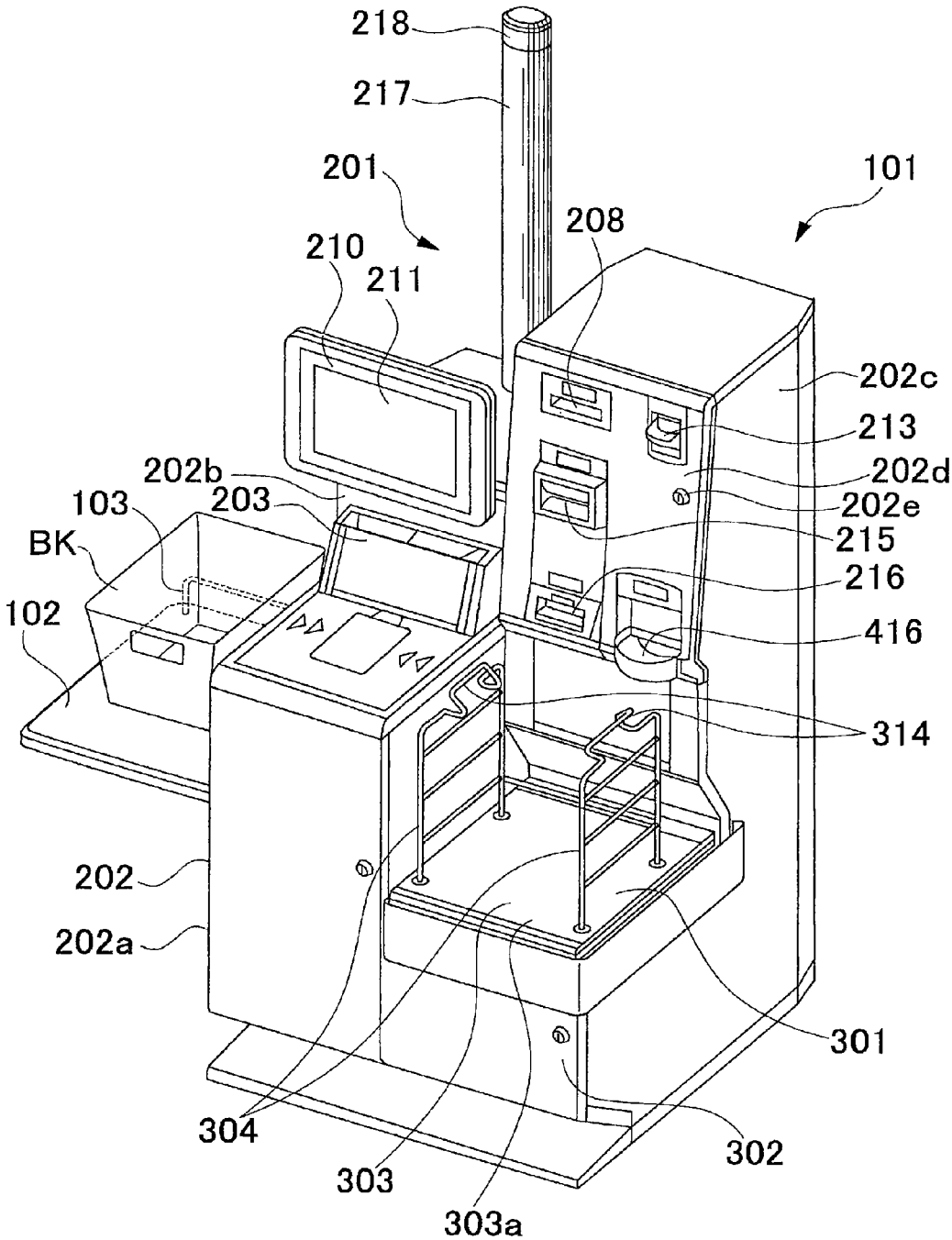
FIG. 2 is a perspective view showing a whole self-checkout terminal.

FIG. 2 is a perspective view showing the whole self-checkout terminal 101. The self-checkout terminal 101 includes the settlement terminal 201 and the weighing apparatus 301.

An outside part of the settlement terminal 201 is a housing 202 which houses various units of the settlement terminal 201. The housing 202 includes a base housing 202*a* which is laid out on a floor, a small upper housing 202*b* which is laid out on a backside area of atop surface of the base housing 202*a*, a right housing 202*c* which is laid out on a right side of the upper housing 202*b*, and a door panel 202*d* which is laid out on a front face of the right housing 202*c*. A basket placement table 102 for placing a basket BK in which items to be purchased by a customer are put is laid out on a left side of the base housing 202*a*. The basket placement table 102 has a frame 103 on its top surface. The frame 103 positions the basket BK.

Various user interfaces are laid out on the housing 202 (above all, the upper housing 202*b*) to make it possible for a customer who faces a front face of the self-checkout terminal 101 to operate the self-checkout terminal 101.

The barcode scanner 203 is provided to the upper housing 202*b*. The barcode scanner 203 scans merchandise codes of various items. An LCD 210 is provided to the upper housing 202*b*. The LCD 210 has the touch panel 211 on its display surface.

An indicating pole 217 which indicates a present condition of the self-checkout terminal 101 stands on a top surface of the upper housing 202*b*. The standing area of the indicating pole 217 is a back side area of the LCD 210. A light emitting unit 218 which emits blue light and red light selectively is provided to a top of the indicating pole 217.

The right housing 202*c* houses a coin unit 221 (see FIG. 3), a bill recycling machine (not shown), a receipt printer 251 (see FIG. 3), and so on. The door panel 202*d* is provided to a front face of the right housing 202*c*. A left side of the door panel 202*d* is connected to the right housing 202*c* for the door panel 202*d* to open. The door panel 202*d* is lockable by a lock 202*e* which is provided to a right side of a front face of the door panel 202*d*. A coin inlet 213 for injection of coins into the self-checkout terminal 101 is provided to an upper right side of the front face of the door panel 202*d*. A coin receiver 416 for receiving coins that the self-checkout terminal 101 puts out is provided to an area below the coin inlet 213 and of the front face of the door panel 202*d*. A bill inlet 215 for injection of bills into the self-checkout terminal 101 is provided to a left side of the front face of the door panel 202*d*. A bill outlet 216 for putting out bills from the self-checkout terminal 101 is provided to an area below the bill inlet 215 and of the front face of the door panel 202*d*.

A receipt outlet 208 is provided to an area above the bill inlet 215 and of the front face of the door panel 202*d*. The receipt printer 251 (see FIG. 3) is provided to a back side of the receipt outlet 208. A receipt (not shown) printed by the receipt printer 251 is issued from the receipt outlet 208.

The weighing apparatus 301 is provided to an area which is at a left side of the base housing 202*a* and a front side of the right housing 202*c*. The weighing apparatus 301 includes a weighing plate 303 which is on a top of the weighing apparatus housing 302 and a pair of bag holding frames 304 which are on the top of the weighing plate 303. The bag holding frames 304 face each other. A top surface of the weighing plate 303 is a placement table 303*a*. The bag holding frames 304 stand on the placement table 303*a*. The upper part of each of the bag holding frames 304 is bent inside for the upper part to be a bag holder 314 on which a handle of a bag like a plastic bag is hung.

The weighing apparatus 301 inside includes a loadcell unit (not shown) which weighs items placed on the weighing plate 303 and sends an output signal. The output signal sent by the loadcell unit is amplified by an amplifier (not shown). The amplified output signal is converted into a digital signal by an analog-digital converter (not shown). An operation part (not shown) makes a weight analysis based on the digital signal and sends weight data as a result of the weight analysis to the settlement terminal 201 through a sending part (not shown).

Next, various units the right housing 202*c* houses are explained.

Figure 3:
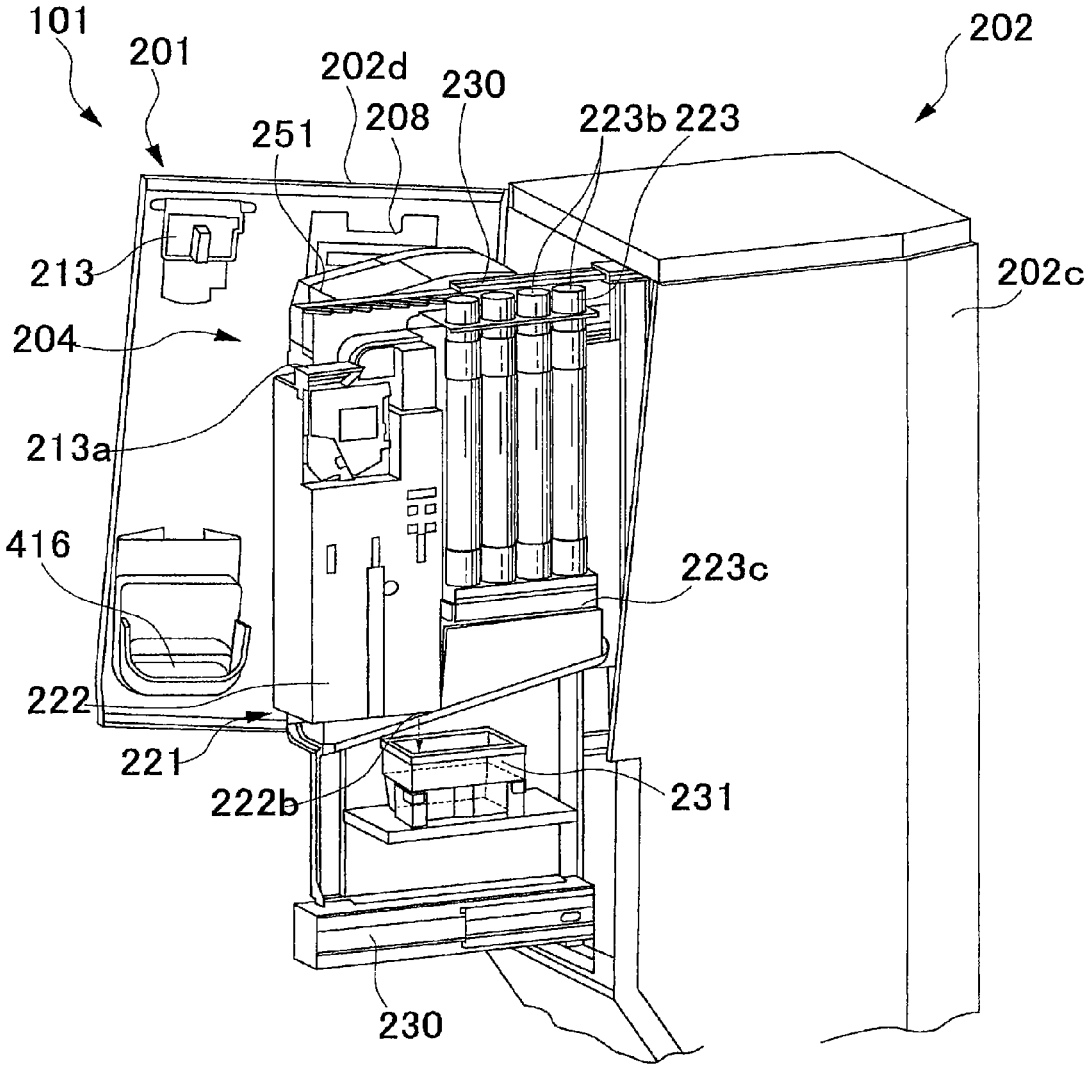
FIG. 3 is a perspective view showing the self-checkout terminal with an inner unit pulled out.

FIG. 3 is a perspective view showing the self-checkout terminal 101 with an inner unit 204 pulled out.

The coin unit 221, the bill recycling machine (not shown), and the receipt printer 251 are unitized into the inner unit 204. The inner unit 204 is stored in the right housing 202*c*. A slide rail mechanism 230 makes it possible to pull the inner unit 204 from the right housing 202*c* and to push the inner unit 204 into the right housing 202*c*. The bill recycling machine is provided to a left side of the coin unit 221 adjacently when seen from the front side of the self-checkout terminal 101, though the bill recycling machine is hidden by the coin unit 221 in FIG. 3.

A positional relationship between the coin inlet 213 which is provided to the door panel 202*d* and an entry part 213*a* of the coin unit 221 is explained. When the coin unit 221 is pushed into the right housing 202*c* and the door panel 202*d* is shut, a coin which is inserted into the coin inlet 213 falls down to the entry part 213*a* and enters the coin unit 221 through the entry part 213*a*.

A positional relationship between the coin receiver 416 which is provided to the door panel 202*d* and a coin passing gate 415 of the coin slope 401 described below is explained. When the coin unit 221 is pushed into the right housing 202*c* and the door panel 202*d* is shut, a coin which passes the coin passing gate 415 falls down to the coin receiver 416.

The coin unit 221 includes a coin recycling machine 222 and an extra tube 223 which are unitized. Coins of type "X" can be put in the coin recycling machine 222, and the coin recycling machine 222 ejects the coins. The extra tube 223 ejects coins of type "Y". The coin recycling machine 222 is provided to a front side of the extra tube 223 adjacently.

The entry part 213*a* which opens upward is provided to a front side of an upper side of the coin recycling machine 222 in order to induct a coin C into the coin recycling machine 222. A coin outlet 222*a* (see FIG. 5) and a sub coin outlet 222*b* are provided to an underside of the coin recycling machine 222. Each of them ejects the coin C. A coin path (not shown) which extends downward from the entry part 213*a* and in which the coin C falls down by its own weight is provided to the inside of the coin recycling machine 222. The coin path includes a first path (not shown) which diverges from a sorting mechanism (not shown) sorting the coin C to the coin outlet 222*a* and a second path (not shown) which diverges from the sorting mechanism to the sub coin outlet 222*b*. An identification part (not shown) which identifies a type of a coin is provided to a position between the entry part 213*a* and the sorting mechanism. The sorting mechanism makes the coin C of type "X" go to the first path and makes the coin C of the other type go to the second path selectively based on a identification result by the identification part. The coin C of type "X" which is made to go to the first path is stored in a storing part (not shown) which can store a coin by the coin type and which is provided to a middle of the first path. The coin C of type "X" stored in the storing part is ejected through the coin outlet 222*a* according to a command for ejection by a controller (not shown) of the settlement terminal 201. On the other hand, the coin C of the other type which is made to go to the second path falls down by its own weight to eject through the sub coin outlet 222*b*. For example, a coin recycling machine (model name: J2000) manufactured by Jofemar is can be applied to the coin recycling machine 222 with the function described above. A coin recycling machine which distinguishes a fake coin from a non-fake coin and which ejects a fake coin to a rejection part (not shown) can be applied, too. In summary, the coin recycling machine 222 ejects some of the things which are injected through the coin inlet 213 through the sub coin outlet 222*b* selectively.

The four extra tubes 223 are provided for respective coin types with their axial direction being vertical. The top part of each of the extra tubes 223 is opened to be an intake part 223*b* which permits an intake of the coin C into the extra tube 223. The coin C which is taken through the intake part 223*b* is ejected through an extra tube coin outlet 223*c* which is provided to an under part of the extra tube 223 by an ejection mechanism (not shown) which ejects the coin C according to a control from a controller (not shown) of the settlement terminal 201. On condition that the coin C of type "Y" not stored in the coin recycling machine 222 is stored in the extra tube 223 preliminarily, the extra tube 223 ejects the coin C according to a control from the controller of the settlement terminal 201.

The coin slope 401 is provided to a position to which the coin C ejected through the coin outlet 222*a* or the extra tube coin outlet 223*c* falls down and which is at an underside of the coin unit 221. The coin slope 401 makes the ejected coin C slide down by its own weight to the coin receiver 416 with the door panel 202*d* shut.

The coin slope 401 is not provided to an underside of the sub coin outlet 222*b* of the coin recycling machine 222. The coin C ejected through the sub coin outlet 222*b* falls down to an area underside of the coin slope 401 without being disturbed. On the area, a coin storing case 231 which can store coins is laid out. So, the coin of type "Y" ejected through the sub coin outlet 222*b* will be stored in the coin storing case 231.

Next, the coin slope 401 is further explained based on FIGS. 4 to 11.

Figure 4:
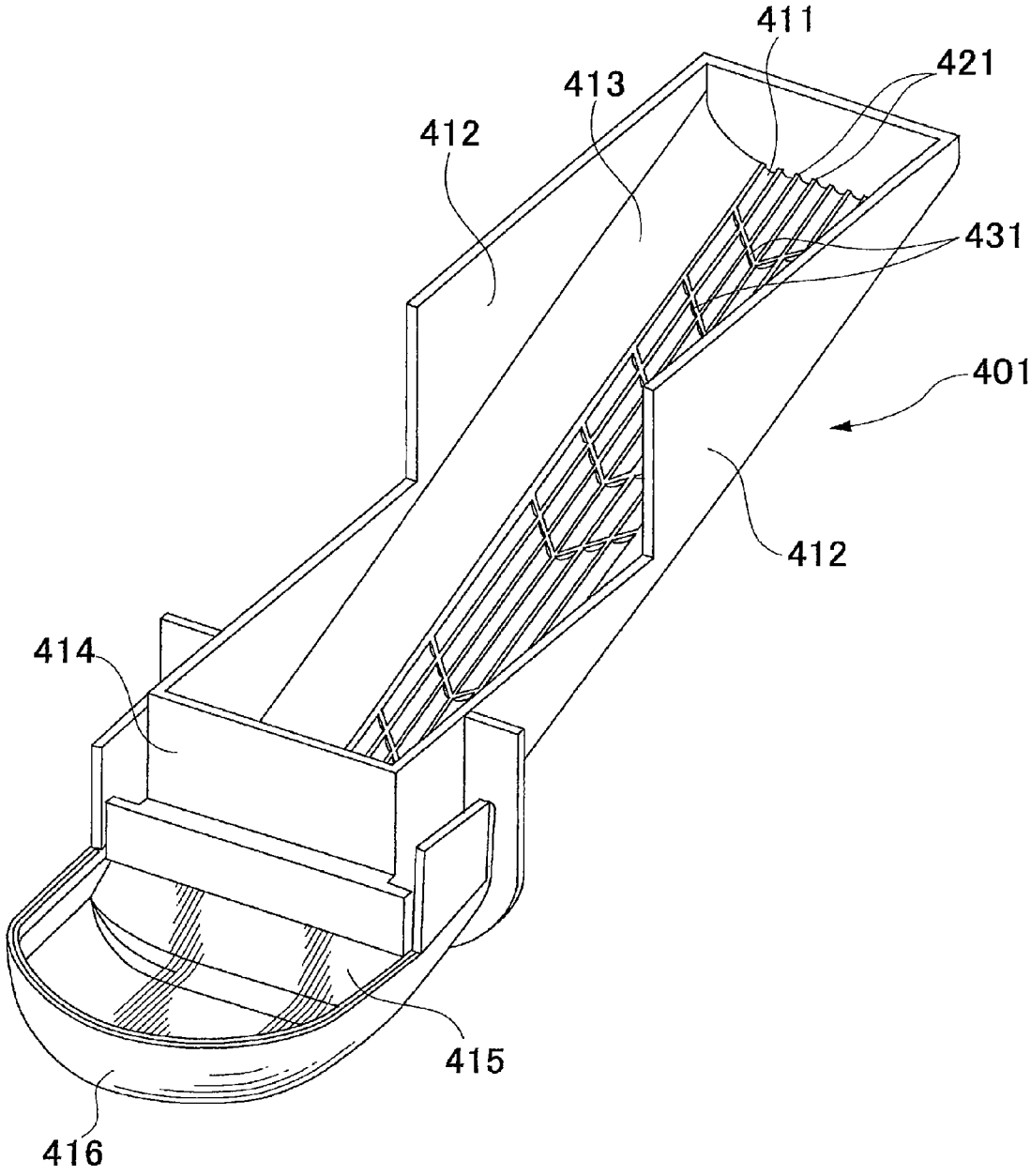
FIG. 4 is a perspective view showing a coin slope according to the first embodiment.

FIG. 4 is a perspective view showing the coin slope 401 according to the first embodiment. The coin slope 401 includes a sloping surface 411 which is slanted with respect to the horizontal. On the sloping surface 411, longwise ribs 421 and diagonal ribs 431 are provided. The longwise rib 421 extends from an upper area of the sloping surface 411 to a lower area of the sloping surface 411. The diagonal rib 431 gets across the longwise rib 421. The longwise rib 421 and the diagonal rib 431 are further explained below.

Side surface parts 412 are provided to both sides of the sloping surface 411. The side surface part 412 prevents the coin C from dropping out of the coin slope 401. The sloping surface 411 and the side surface part 412 are connected by a curved surface part 413. The corner of the curved surface part 413 is rounded off. A front face panel 414 like a double-deck panel member is provided to a front side (left lower side in FIG. 4) of the coin slope 401. The front face panel 414 is integrated with both of the side surface parts 412. A lower end of the front face panel 414 does not reach an extension of the sloping surface 411 (see FIG. 5). The coin passing gate 415 through which the coin C passes is provided to a lower side of the front face panel 414. When the door panel 202*d* (not shown in FIG. 4) is shut, the coin passing gate 415 is connected to the coin receiver 416 provided to the door panel 202*d*.

Figure 5:
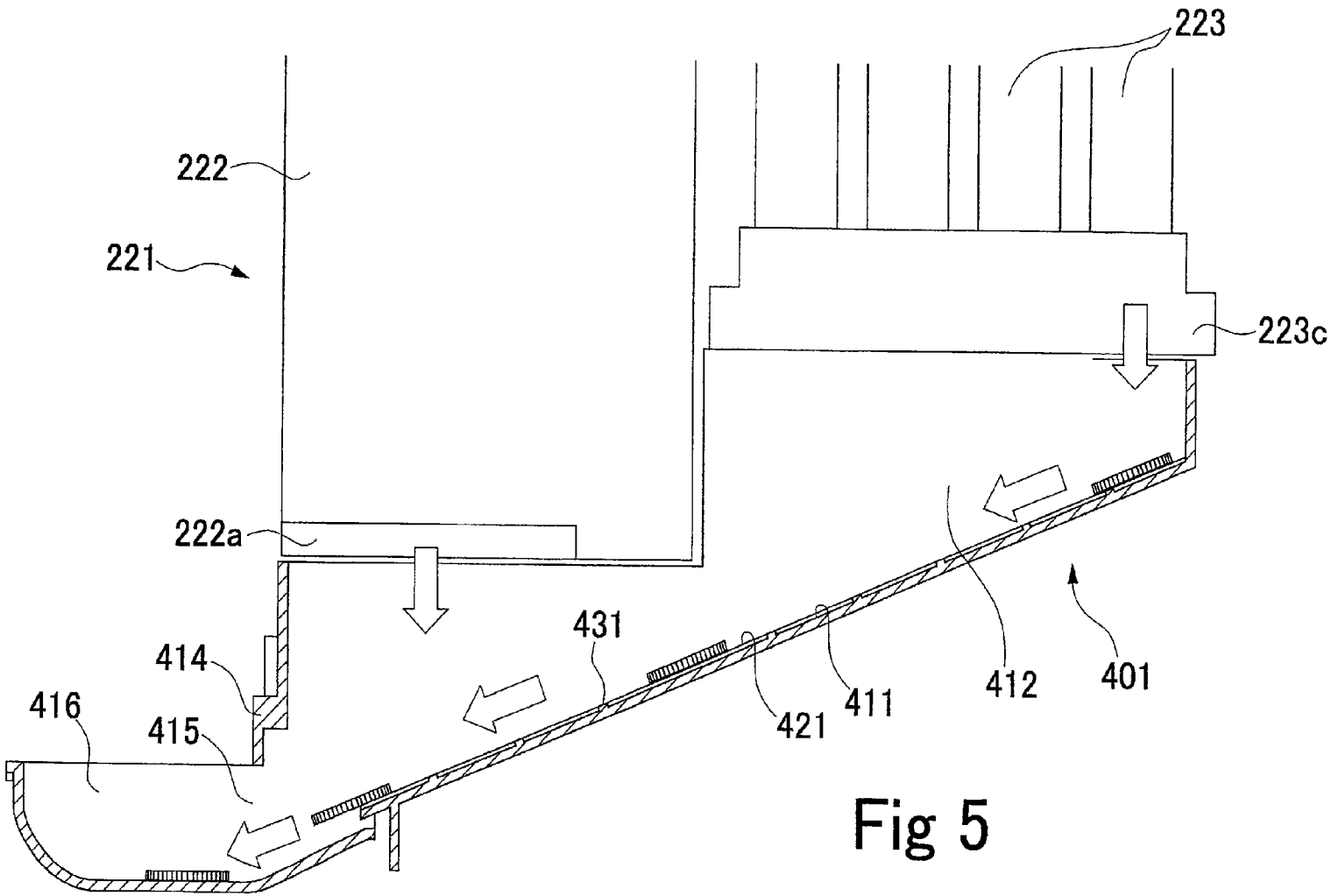
FIG. 5 is a side view in vertical section showing the coin slope according to the first embodiment.

FIG. 5 is a side view in vertical section showing the coin slope 401 according to the first embodiment. In FIG. 5, the coin unit 221 is shown schematically.

As shown in FIG. 5, a length of a front-back direction (a left-right direction in FIG. 5) of the coin slope 401 which is provided to an underside of the coin recycling machine 222 and the extra tube 223 is comparable to a length of a front-back direction of both of the coin recycling machine 222 and the extra tube 223. The length of the coin slope 401 is further explained. The sloping surface 411 includes both an area to which the coin C ejected through the extra tube coin outlet 223*c* of the most backward extra tube 223 falls down and an area to which the coin C ejected through the coin outlet 222 falls down. A position of the coin slope 401 in a left-right direction in the right housing 202*c* is explained. Both the extra tube coin outlet 223*c* and the coin outlet 222*a* are in a width of the sloping surface 411. Therefore, the sloping surface 411 of the coin slope 401 can receive the coin C ejected through the coin outlet 222*a* or the extra tube coin outlet 223*c*.

Figure 6:
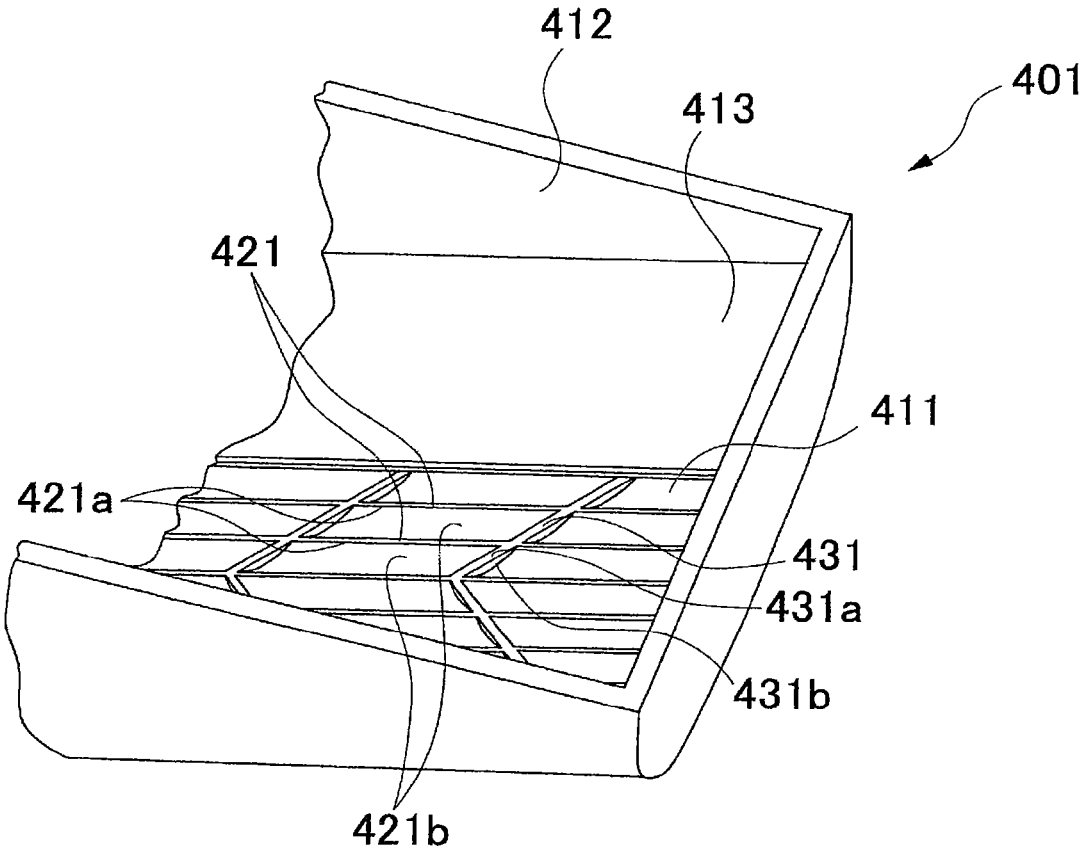
FIG. 6 is an enlarged perspective view showing the coin slope according to the first embodiment.
Figure 7:
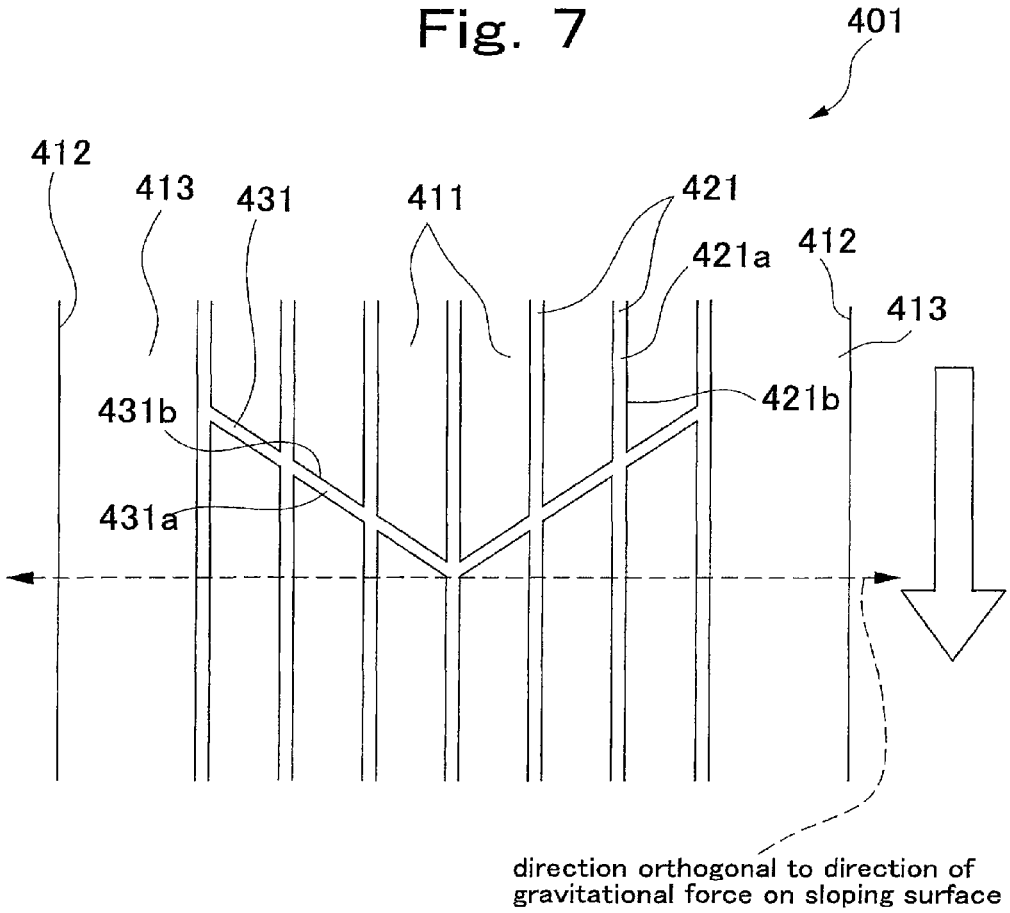
FIG. 7 is a schematic plan view showing the coin slope according to the first embodiment.

FIG. 6 is an enlarged perspective view showing the coin slope 401 according to the first embodiment. FIG. 7 is a schematic plan view showing the coin slope 401 according to the first embodiment. The longwise ribs 421 are provided to the sloping surface 411 adjacently to each other. A distance between the two adjacent longwise ribs 421 is longer than a thickness of the coin C. The longwise ribs 421 are parallel to one another. A top surface of the longwise ribs 421 is a longwise rib top surface 421*a*. Each of the longwise ribs 421 has the same height. Therefore, the longwise rib top surfaces 421*a* of the longwise ribs 421 make a virtual plane.

The sloping surface 411 is further explained. As shown in FIG. 6, the longwise rib 421 has a curved side surface which curves up from the adjacent sloping surface 411. The side surface is called a longwise rib side surface 421*b*. The longwise rib side surface 421*b* is integrated with the sloping surface 411. Consequently, the sloping surface 411 between the two longwise ribs 421 is curved in an arc.

The diagonal rib 431 forms an arrow pointing to the coin receiver 416. That is, as shown in FIG. 7, the diagonal rib 431 diagonally crosses a direction orthogonal to a direction of a gravitational force on the sloping surface 411. The direction of the gravitational force on the sloping surface 411 means one component of a direction of the gravitational force, the component is a component of a slope direction of the sloping surface 411.

The diagonal rib 431 is further explained. Two ribs inclined from a side part of the sloping surface 411 to a center part of the sloping surface 411 are connected to each other at the center part so as to form an arrow. In this, the diagonal rib 431 gets across the longwise rib 421. The diagonal rib top surfaces 431*a* have the same height as the longwise rib top surfaces 421*a*. The diagonal ribs 431 are provided along a longer direction of the sloping surface 411 at regular intervals (see FIG. 4).

The diagonal rib side surface 431*b* connected to the diagonal rib top surface 431*a* has an arc-like base which runs along the sloping surface 411 and the longwise rib side surface 421*b*.

Next, a case that the coin C ejected through such as the extra tube 223 is made to slide down to the coin receiver 416 by the coin slope 401 is explained. For example, when the coin C is ejected through the extra tube coin outlet 223*c*, the ejected coin C slides down by its own weight with its one surface on the virtual plane which is made by the longwise rib top surface 421*a* (see FIG. 5). A width of the longwise rib top surface 421*a* and a width of the diagonal rib top surface 431*a* is narrower than the surface of the surface of the coin C. So, the coin C does not stop in its sliding down because a contact resistance against the longwise rib top surface 421*a* and the diagonal rib top surface 431*a* is relative low. For the coin C sliding down by its own weight, the sloping surface 411 is inclined at a predefined angle so as riot to stop the coin C on the way.

Sometimes, the ejected coin C drops in a gap between the two longwise ribs 421 and stands on the sloping surface 411 between the two longwise ribs 421 without lying on the longwise rib top surface 421*a*.

Figure 8:
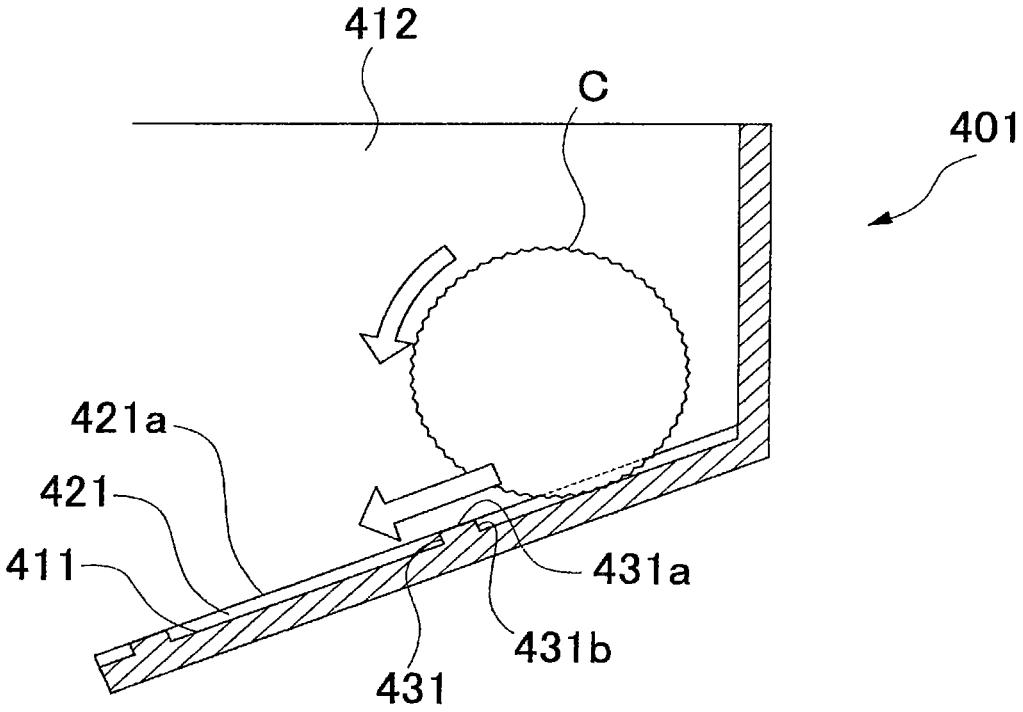
FIG. 8 is a side view in vertical section showing the coin slope with a coin dropping in a gap between two longwise ribs according to the first embodiment.
Figure 9:
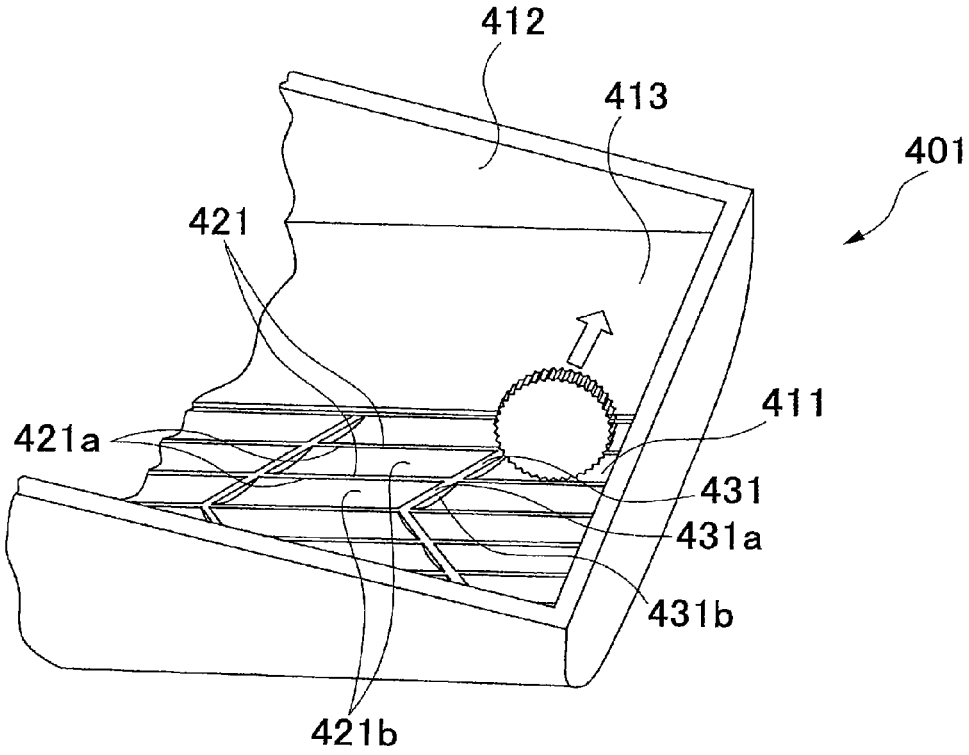
FIG. 9 a perspective view showing the coin slope with the coin dropping in the gap between the two longwise ribs according to the first embodiment.

FIG. 8 is a side view in vertical section showing the coin slope 401 with the coin C dropping in the gap between the two longwise ribs 421 according to the first embodiment. FIG. 9 a perspective view showing the coin slope 401 with the coin C dropping in the gap between the two longwise ribs 421 according to the first embodiment.

The coin C which drops in the gap between the two longwise ribs 421 rolls down by its own weight on the sloping surface 411 along the longwise rib 421. The coin C which is ejected through the extra tube coin outlet 223*c* falls down to an upper side of the sloping surface 411. Therefore, if the diagonal rib 431 had been not provided, the coin C would rush to the coin receiver 416 and would jumps out of the coin receiver 416.

However, in the first embodiment, the diagonal rib 431 is provided to a position where the diagonal rib 431 interferes with a trajectory of the coin C which rolls down between the two longwise ribs 421. Therefore, the coin C which rolls down between the two longwise ribs 421 bumps against the diagonal rib 431. Because the diagonal rib 431 diagonally crosses a direction of the coin C movement, an edge of a one side of the coin C bumps the diagonal rib 431, first. So, a lower edge of the coin C is pushed by the diagonal rib 431 from outside. And, an upper edge of the coin C falls down outward (a direction of an arrow in FIG. 9).

Figure 10:
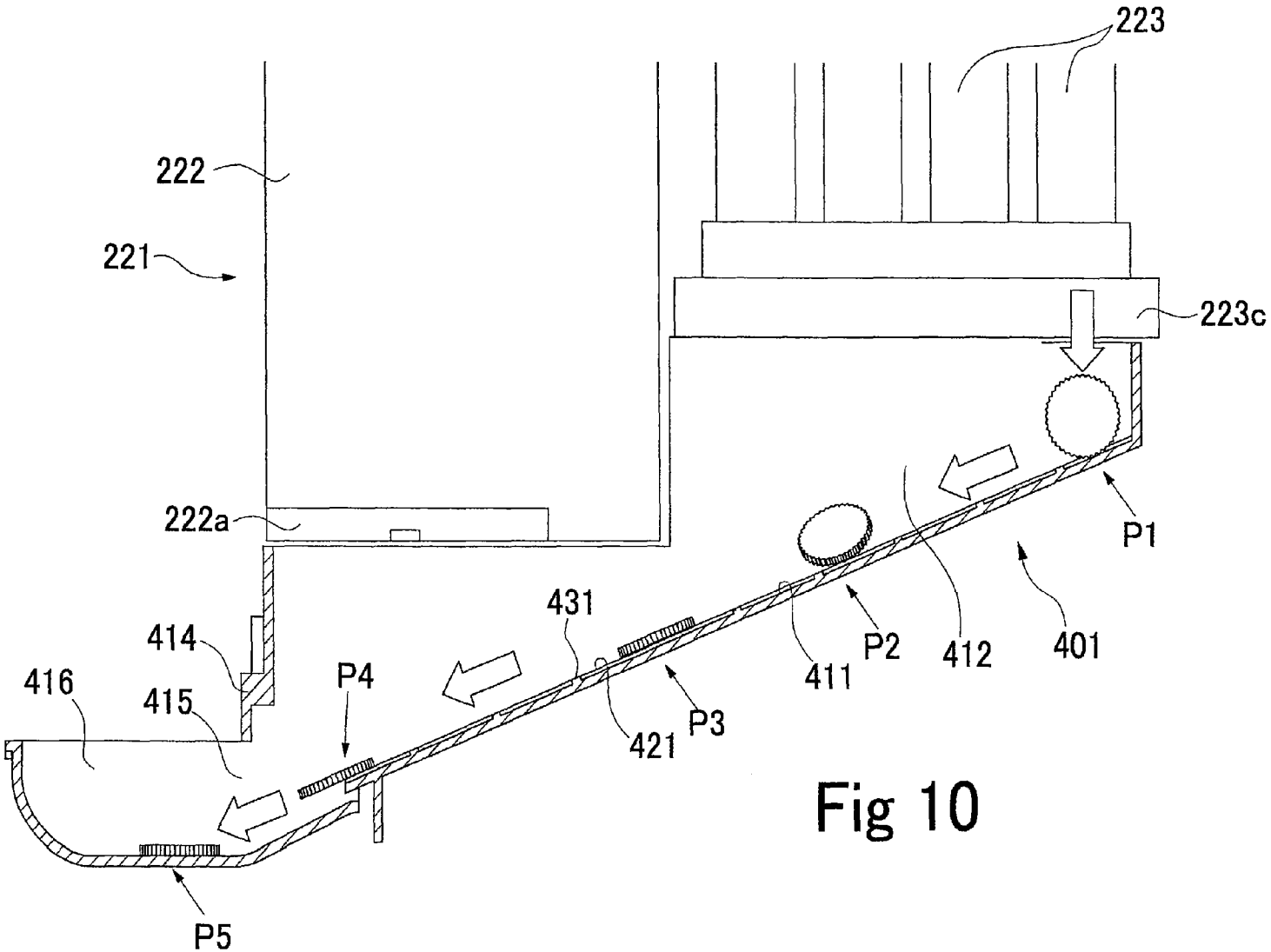
FIG. 10 is a side view in vertical section showing the coin slope with a coin sliding down.

FIG. 10 is a side view in vertical section showing the coin slope 401 with the coin C sliding down. First, the coin C ejected through the most backward extra tube coin outlet 223*c* drops in the gap between the two longwise ribs 421 (position P1). Next, because the coin C bumps against the diagonal rib 431, an upper edge of the coin C is taken down outward, as previously indicated (position P2). So, the coin C lies on the longwise rib top surfaces 421*a* (position P3). The coin C laid on the longwise rib top surface 421*a* slides down and reaches the coin passing gate 415 (position P4). Finally, the coin C is received by the coin receiver 416 (position P5).

As described above, according to the first embodiment, the ejected coin C slides down by its own weight lying on the longwise rib top surface 421*a* without rolling down on the sloping surface 411. So, the coin C is prevented from rushing to the coin receiver 416 and jumping out of the coin receiver 416.

The diagonal rib 431 should be a member which diagonally crosses the longwise rib 421 from one side of the sloping surface 411 to the other side, and it is not limited to a member which forms an arrow.

Figure 11:
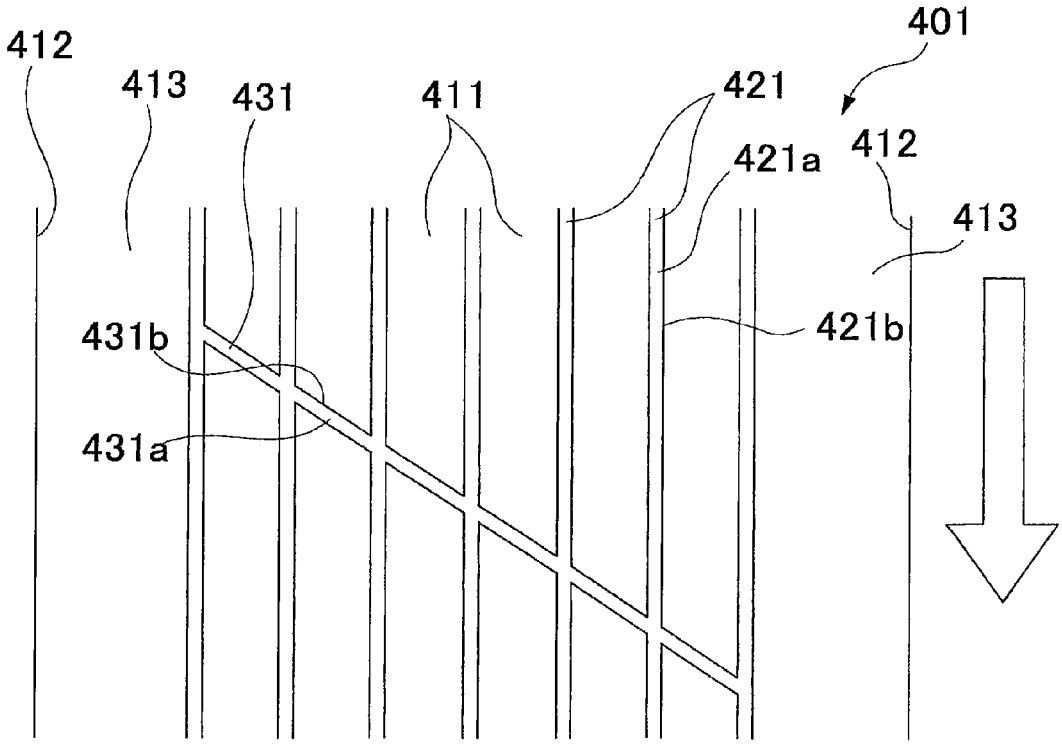
FIG. 11 is a schematic diagram showing another example of the diagonal rib.

FIG. 11 is a schematic diagram showing another example of the diagonal rib 431. The diagonal rib 431 shown in FIG. 11 does not form an arrow, but rather forms a straight line from one side of the sloping surface 411 to the other. In this case, the diagonal rib top surface 431*a* has the same height as the longwise rib top surface 421*a*.

In the case that the present example of the diagonal rib 431 is provided, the ejected coin C slides down by its own weight lying on the longwise rib top surfaces 421*a* without rolling down on the sloping surface 411. So, the coin C is prevented from rushing to the coin receiver 416 and jumping out of the coin receiver 416.

Figure 12:
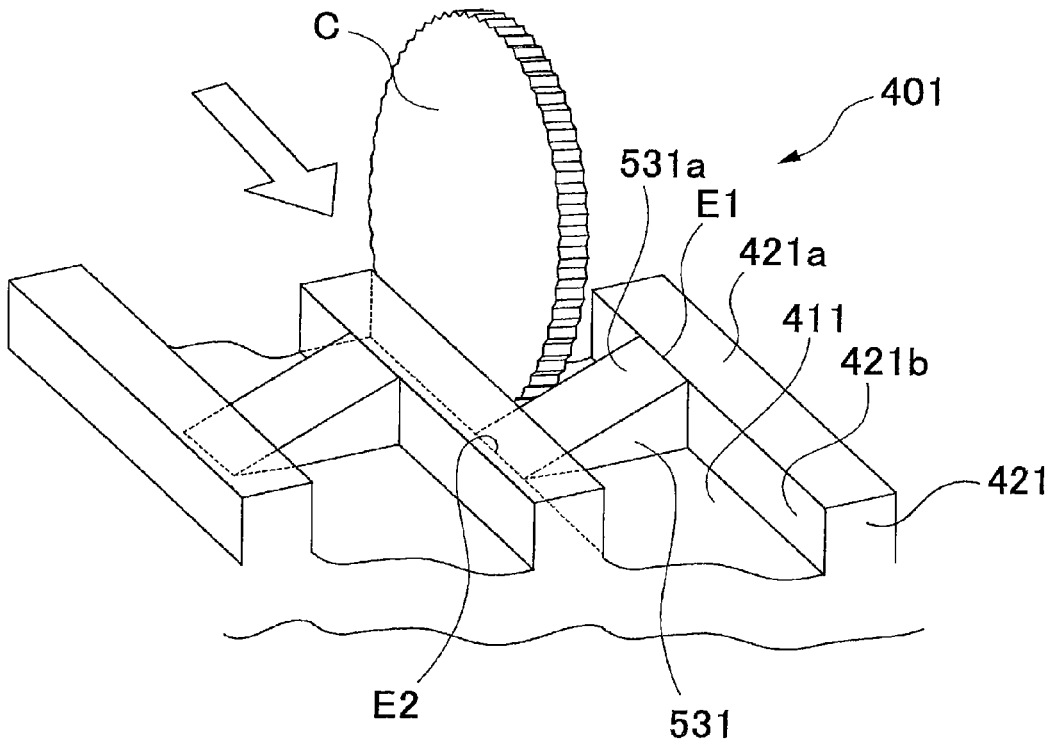
FIG. 12 is an enlarged perspective view showing the coin slope according to the second embodiment.

Next, a second embodiment of the present invention is explained based on FIGS. 12 to 13. Any member that is same as a member in the first embodiment explained based on FIGS. 1 to 11 is shown by the same numeral or letter, and an explanation thereof is skipped. In the second embodiment, instead of the diagonal rib 431, an interference member 531 is provided between longwise ribs 421.

FIG. 12 is an enlarged perspective view showing the coin slope 401 according to the second embodiment. The interference member 531 is provided on the sloping surface 411 between the two longwise ribs 421. The interference member 531 includes a slope top surface. The surface is called the interference member top surface 531*a*. A higher edge of the interference member top surface 531*a* connects with an edge E1 of the longwise rib 421 which is provided to one side of the interference member 531. The edge E1 is formed by the longwise rib top surface 421*a* and the longwise rib side surface 421*b* of the longwise rib 421. A lower edge of the interference member top surface 531*a* connects with an edge E2 of the longwise rib 421 which is provided to the other side of the interference member 531. The edge E2 is formed by the longwise rib side surface 421*b* of the longwise rib 421 and the sloping surface 411 which the interference member 531 is on. The interference member top surface 531*a* should be a slope surface, and the higher edge of the interference member top surface 531*a* may connect with a position of the longwise rib side surface 421*b* which is lower than the edge E1. The lower edge of the interference member top surface 531*a* may connect with a position of the longwise rib side surface 421*b* which is higher than the edge E2 but lower than the edge E1.

The sloping surface 411 in the second embodiment is a flat surface but may be curved in an arc like the sloping surface 411 in the first embodiment.

In the second embodiment, as a plurality of the interference members 531 are provided linearly, it is like a rib orthogonal to a longer direction of the longwise rib 421. Then, as shown in FIG. 12, the coin C which rolls down on the sloping surface 411 between the two longwise ribs 421 bumps against one of the interference member 531.

Figure 13A:
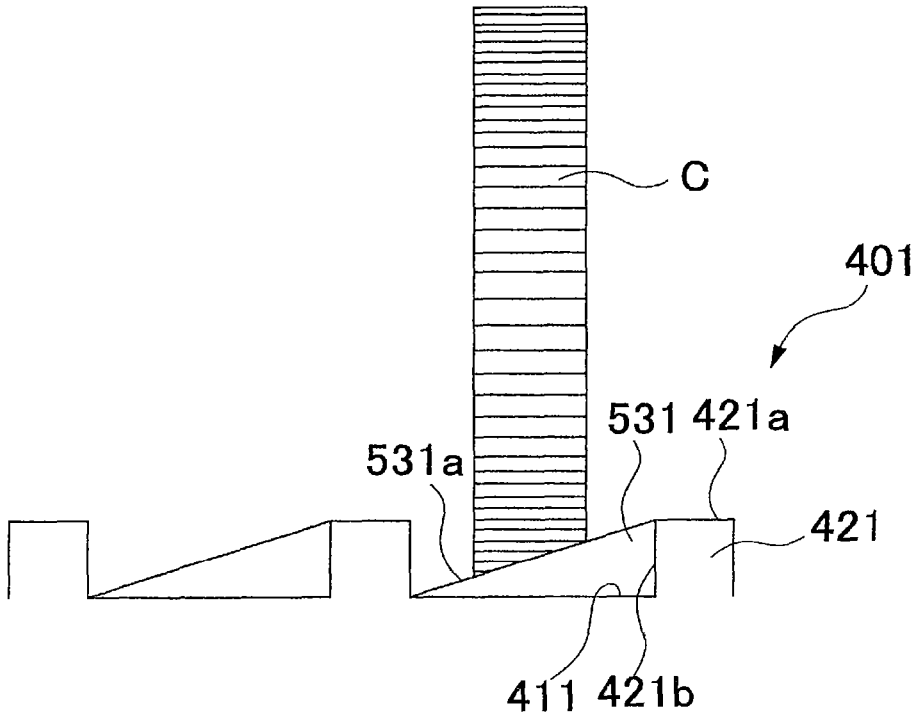
FIGS. 13A and 13B are sectional views showing the coin slope according to the second embodiment.
Figure 13B:
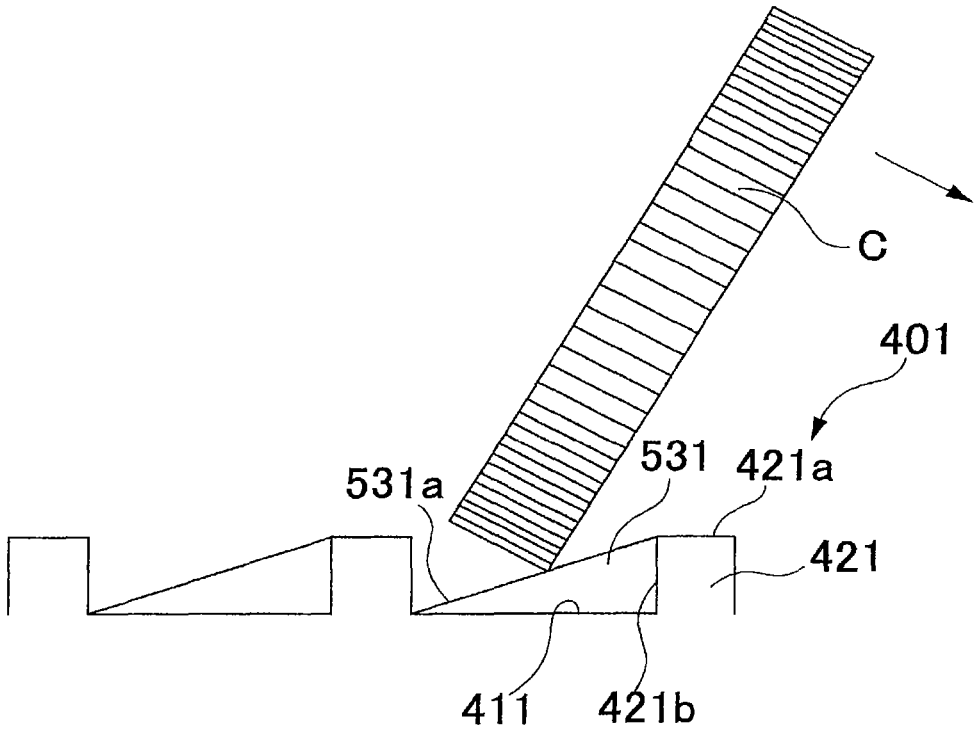
Figure 14:
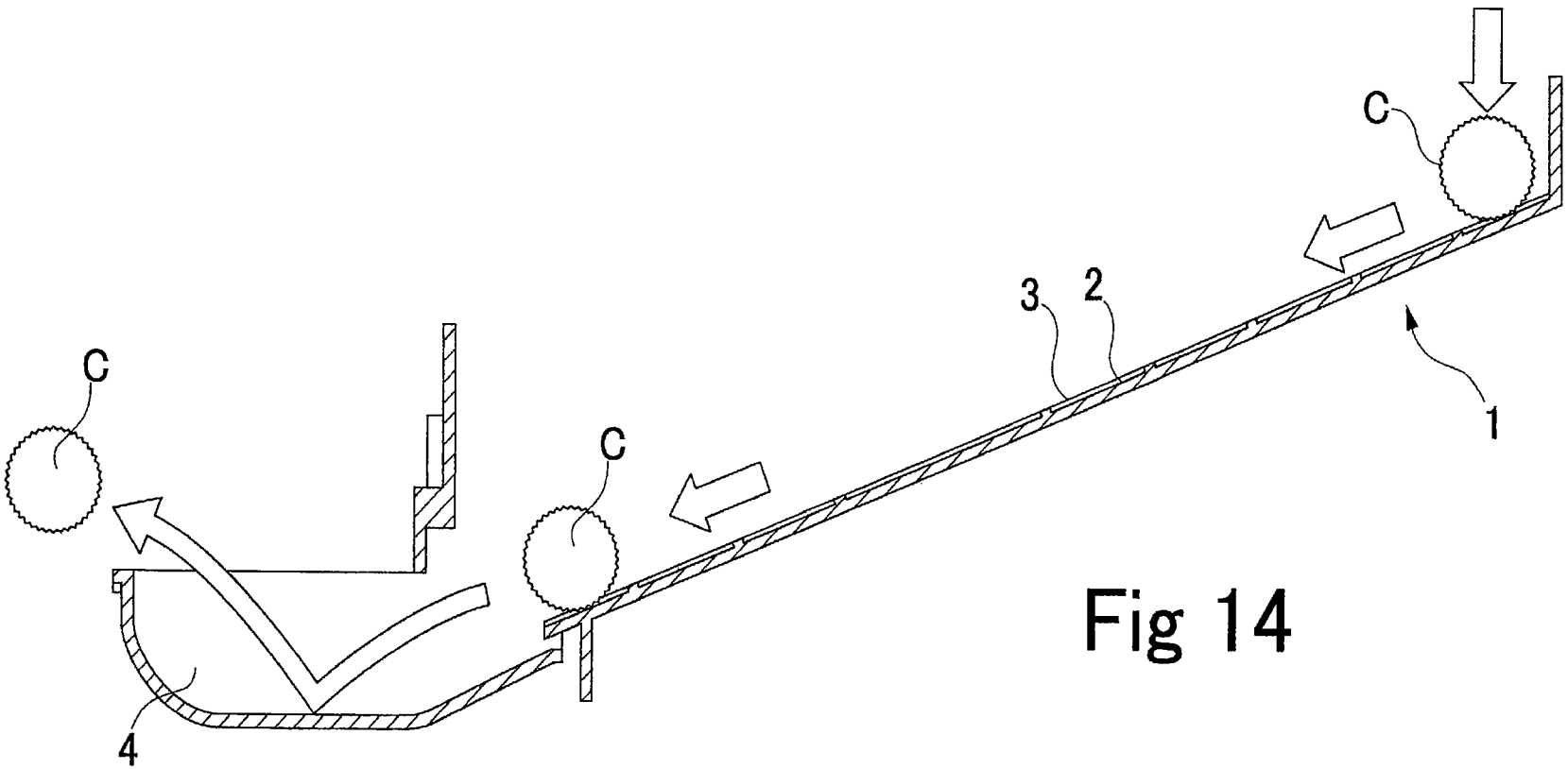
FIG. 14 is a side view in vertical section showing a coin slope.
Figure 15:
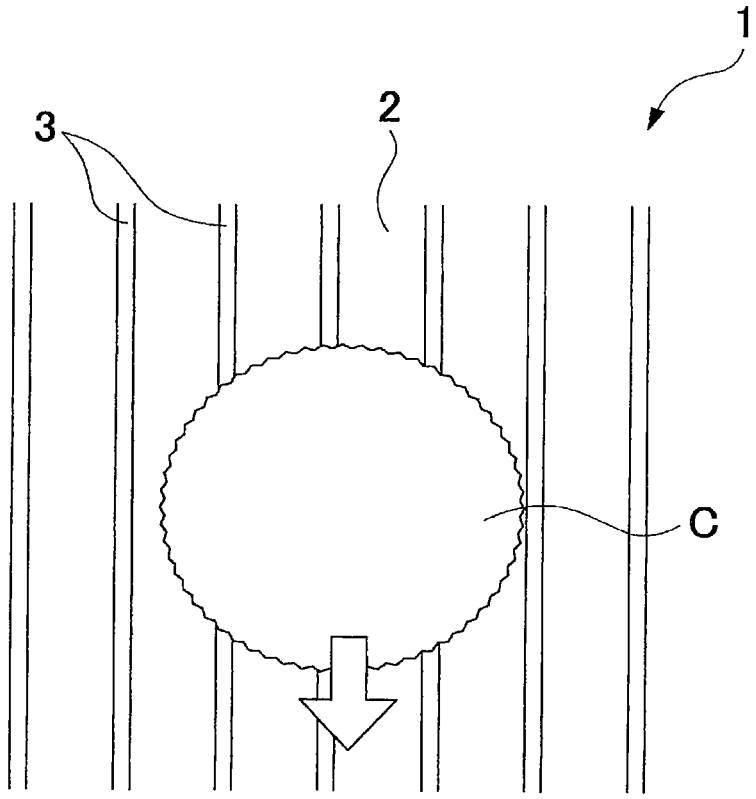
FIG. 15 is a schematic plan view showing a part of the coin slope.
Figure 16:
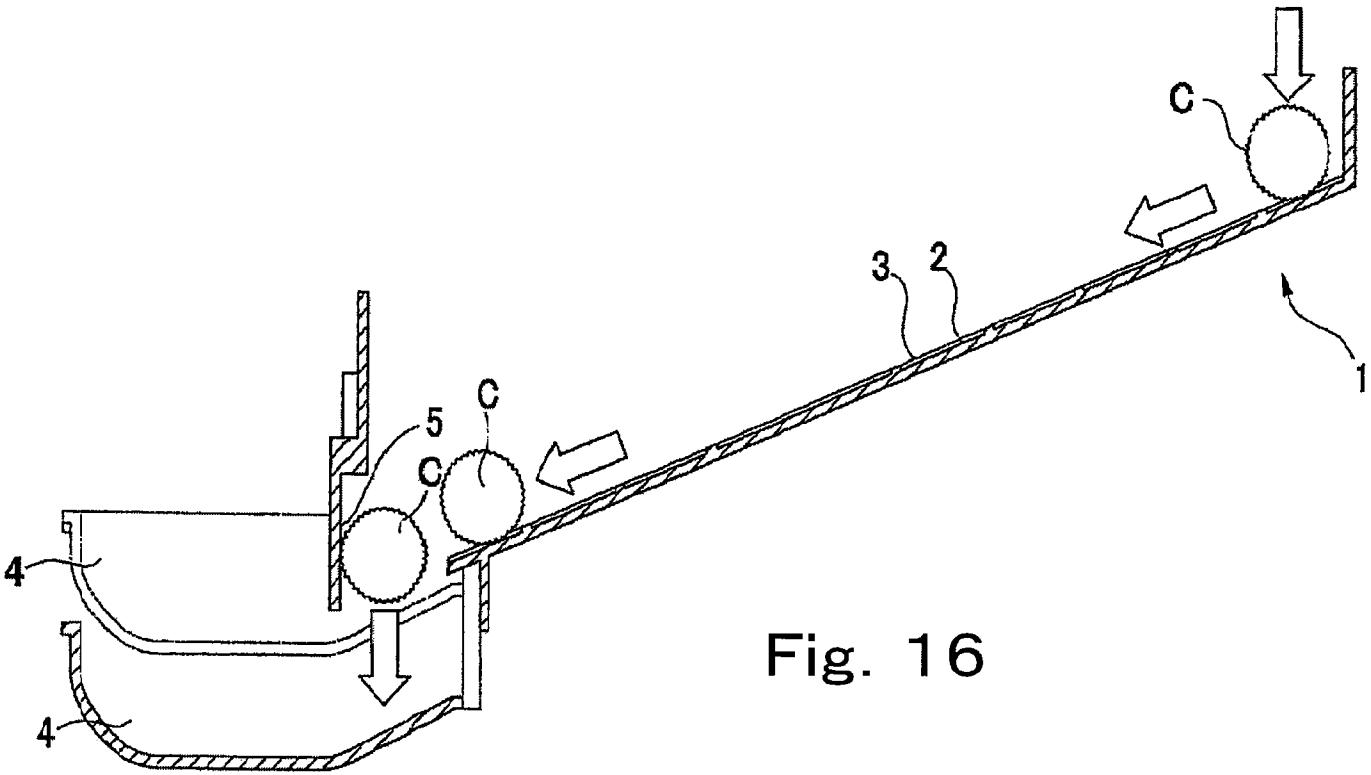
FIG. 16 is a side view in vertical section showing the coin slope to which a bumping wall is provided.

FIGS. 13A and 13B are sectional views showing the coin slope 401 according to the second embodiment. In FIG. 13A, the coin C just before bumping against the interference member 531 is shown. Then, one side of a lower edge of the coin C bumping against the interference member 531 is pushed by the interference member 531. Therefore, as shown in FIG. 13B, an upper edge of the coin C is taken down. So, the coin C is laid on the longwise rib top surface 421*a* and the laid coin C slides down to the coin receiver 416.

As described above, according to the second embodiment, the ejected coin C slides down by its own weight lying on the longwise rib top surface 421*a* without rolling down on the sloping surface 411. So, the coin C is prevented from rushing to the coin receiver 416 and jumping out of the coin receiver 416.

In the first embodiment and the second embodiment, the example of the application to the coin slope 401 which is provided to the self-checkout terminal 101 is shown. But, the present invention may be applicable to a coin slope provided to another coin ejecting machine (for example, a beverage vending machine, a parking ticket vending machine, etc).

Obviously, numerous modifications and variations of the present invention are possible in light of the above teachings. It is therefore to be understood that within the scope of the appended claims, the invention may be practiced otherwise than as specifically described herein.

What is claimed is:

1. A coin slope comprising:

a sloping surface which slopes downward;

longwise ribs which are provided on the sloping surface, the longwise ribs being adjacent to each other and extending from an upper area of the sloping surface to a lower area of the sloping surface; and a pair of diagonal ribs which are provided on the sloping surface, each of the diagonal ribs being extended from each of side parts of the sloping surface to a center part of the sloping surface and connected to each other at the center part, the diagonal ribs obliquely crossing the longwise ribs to form an arrow pointing to the lower area of the sloping surface, the longwise ribs and the diagonal ribs being the same height in a direction normal to the sloping surface.

2. The coin slope according to claim 1, wherein, on the sloping surface, a position at the center part where the diagonal ribs are connected to each other is lower than positions at the side parts from where the diagonal ribs are extended.

3. The coin slope according to claim 1, wherein a plurality of pairs of diagonal ribs are provided on the sloping surface at a predetermined interval therebetween along a direction of a gravitational force on the sloping surface.

4. The coin slope according to claim 1, wherein the sloping surface is slanted with respect to a horizontal surface.

5. The coin slope according to claim 1, wherein the longwise ribs are parallel with respect to each other.

6. A method comprising:

installing a coin ejecting machine which comprises a coin outlet through which a coin is ejected; and installing a coin slope in a position to which a coin ejected through the coin outlet falls down, wherein the coin slope comprises:

a sloping surface which slopes downward;

longwise ribs which are provided on the sloping surface, the longwise ribs being adjacent to each other and extending from an upper area of the sloping surface to a lower area of the sloping surface; and a pair of diagonal ribs which are provided on the sloping surface, each of the diagonal ribs being extended from each of side parts of the sloping surface to a center part of the sloping surface and connected to each other at the center part, the diagonal ribs obliquely crossing the longwise ribs to form an arrow pointing to the lower area of the sloping surface, the longwise ribs and the diagonal ribs being the same height in a direction normal to the sloping surface.

* * * * *